United States Patent [19]

Oshizawa et al.

[11] Patent Number: 4,727,836

[45] Date of Patent: Mar. 1, 1988

[54] FUEL INJECTION APPARATUS FOR INTERNAL COMBUSTION ENGINE

[75] Inventors: Hidekazu Oshizawa; Kenji Okamoto, both of Higashimatsuyama, Japan

[73] Assignee: Dielsel Kiki Co., Ltd., Japan

[21] Appl. No.: 940,188

[22] Filed: Dec. 9, 1986

Related U.S. Application Data

[63] Continuation of Ser. No. 686,726, Dec. 27, 1984, abandoned.

[30] Foreign Application Priority Data

Dec. 27, 1983 [JP] Japan ..... 58-244825

[51] Int. Cl.[4] ..... F02M 59/20

[52] U.S. Cl. ..... 123/357; 123/501

[58] Field of Search ..... 123/357, 358, 359, 500, 123/501, 502, 436

[56] References Cited

U.S. PATENT DOCUMENTS

| | | | |
|---|---|---|---|
| 3,973,537 | 8/1976 | Williams et al. | 123/357 |
| 4,335,695 | 6/1982 | Phipps | 123/357 |
| 4,426,982 | 1/1984 | Lehner et al. | 123/357 |
| 4,495,916 | 1/1985 | Shinoda | 123/357 |
| 4,502,439 | 3/1985 | Nagase et al. | 123/357 |
| 4,590,908 | 5/1986 | Yoshinaga et al. | 123/357 |

FOREIGN PATENT DOCUMENTS

| | | | |
|---|---|---|---|
| 49704 | 4/1982 | European Pat. Off. | 123/501 |
| 104539 | 4/1984 | European Pat. Off. | 123/357 |
| 113510 | 7/1984 | European Pat. Off. | 123/357 |
| 68535 | 4/1982 | Japan | 123/501 |

*Primary Examiner*—Willis R. Wolfe, Jr.
*Attorney, Agent, or Firm*—Guy W. Shoup

[57] ABSTRACT

In a fuel injection apparatus for an internal combustion engine in which the fuel injection timing and the amount of fuel injection are controlled in response to a signal indicative of the operating condition of the engine, the maximum amount of fuel injection is determined in such a way that the engine torque determined by the maximum amount of fuel injection does not change even when the fuel injection timing is adjusted in accordance with the operating condition of the engine.

9 Claims, 4 Drawing Figures

FUEL INJECTION APPARATUS FOR INTERNAL COMBUSTION ENGINE

This is a continuation application from application Ser. No. 686,726 filed Dec. 27, 1984, now abandoned.

BACKGROUND OF THE INVENTION

1. Field of the Invention

The present invention relates to a fuel injection apparatus for internal combustion engines, and more particularly to a fuel injection apparatus in which maximum fuel injection can be adjusted in accordance with the fuel injection advance.

2. Description of the Prior Art

The control of the amount of fuel injection, especially the control of the maximum amount of fuel injection, of the conventional fuel injection apparatus for internal combustion engines is generally determined on the basis of the rotational speed of the internal combustion engine. However, in Japanese Utility Model Public Disclosure No. 136138/81, there is proposed an apparatus in which the maximum amount of fuel injection is controlled depending upon whether or not the apparatus is in the state that free-acceleration is possible. On the other hand, in controlling the timing of fuel injection, not only the rotational speed of the engine, but also the acceleration of the engine, the coolant temperature, the engine load and the like are generally taken into consideration (i.e., Japanese Patent Publication No. 39285/76).

The control of fuel injection timing in the conventional fuel injection apparatus has a large effect on the torque of the internal combustion engine. More specifically, when the timing of fuel injection varies within a predetermined adjustment range, even if the engine speed and the amount of fuel injection are not changed, the engine torque increases with the advance of fuel injection timing and decreases with increasing lag of the injection timing. Therefore, a fuel injection apparatus constituted by a combination of the prior art apparatuses described above has a disadvantage in that the maximum engine torque varies depending upon the fuel injection timing even when the engine speed is maintained constant, so that the operator experiences a feeling of discomfort.

SUMMARY OF THE INVENTION

It is an object of the invention to provide an improved fuel injection apparatus for internal combustion engines in which maximum engine torque is not affected by adjustment of the fuel injection timing.

It is another object of the invention to provide a fuel injection apparatus for internal combustion engines in which maximum fuel injection is controlled in accordance with the fuel injection timing so as to hold the maximum engine torque to the desired level regardless of the adjustment of the fuel injection timing.

According to the present invention, in a fuel injection apparatus for an internal combustion engine having a first control means for controlling the fuel injection timing in response to at least one signal indicative of the operating condition of the engine and a second control means for controlling the amount of fuel injection in response to at least one signal indicative of the operating condition of the engine, maximum fuel injection is determined on the basis of data concerning the fuel injection timing in such a way that the change that would otherwise occur in the engine torque corresponding to the maximum fuel injection determined in the second control means is canceled regardless of any variation in the fuel injection timing determined by the first control means at each instant.

In this case, data showing the actual fuel injection timing or the target fuel injection timing may be used as the data concerning the fuel injection timing used for determining the maximum fuel injection.

With this invention, the maximum fuel injection is changed in accordance with not only the engine speed but also the fuel injection timing, so that the change in engine torque due to the advance or lag of the fuel timing injection can be controlled so as to be maintained at a predetermined constant value at any maximum amount of fuel injected. As a result, the "feel" of engine operation control sensed by the operator is greatly improved.

The present invention will be better understood and the other objects and advantages thereof will be more apparent from the following detailed description of preferred embodiments with reference to the accompanying drawings.

DESCRIPTION OF THE PREFERRED EMBODIMENTS

Figure 1:
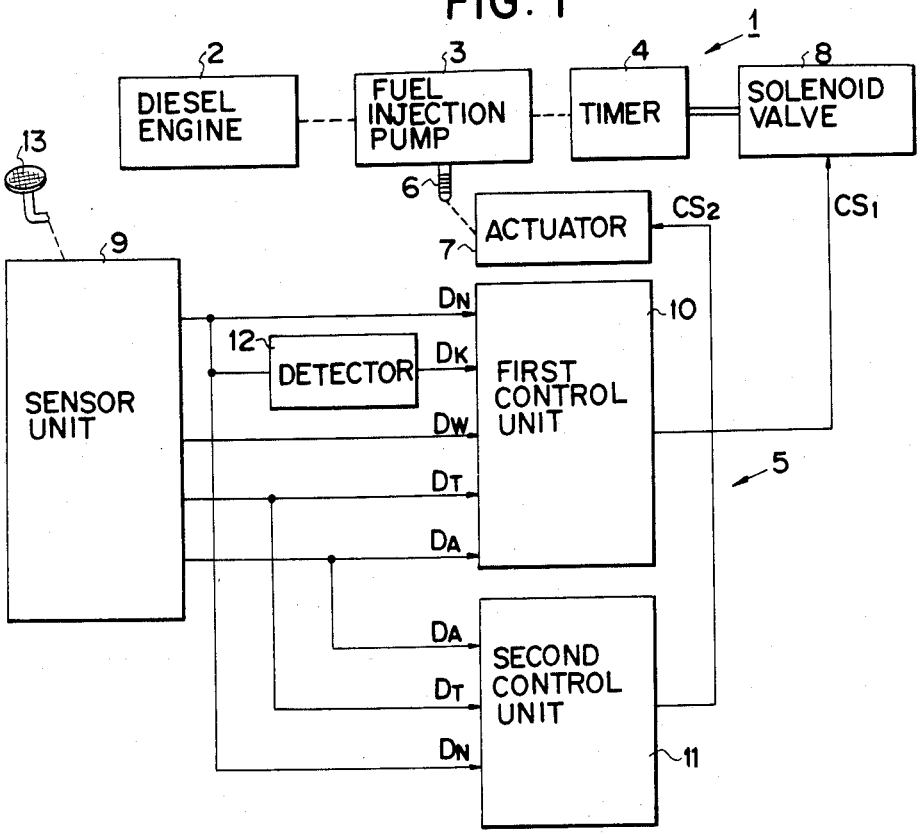
FIG. 1 is a block diagram of an embodiment of the fuel injection apparatus of the present invention.

FIG. 1 shows an embodiment of a fuel injection apparatus of the present invention. A fuel injection apparatus 1 has a fuel injection pump 3 for injecting fuel into a diesel engine 2, and a timer 4 for adjusting the fuel injection timing of the fuel injection pump 3. The fuel injection pump 3 has a control rack 6, which is a fuel adjusting member and is positionally controlled by an actuator 7. The timer 4 has a solenoid valve 8 driven by an electric signal and the adjustment of the fuel injection timing by the timer 4 is carried out by the operation of the solenoid valve 8.

For driving the actuator 7 and the solenoid valve 8 in order to adjust the amount and timing of fuel injection, there is provided a control device 5, which comprises a sensor unit 9, a first control unit 10 and a second control unit 11. From sensors (not shown) in the sensor unit 9, data $D_N$ showing the rotational speed of the diesel engine 2, data $D_W$ showing the temperature of the engine coolant, data $D_T$ showing the actual fuel injection timing and data $D_A$ showing the amount of operation of an accelerator pedal 13 are output. Since the sensor unit 9 for generating these data can be easily constituted by the use of conventional sensors well known in the prior art, no explanation of the detailed structure thereof will be given here. The data $D_N$ is input to a detector 12, in which the acceleration of the diesel engine 2 is computed on the basis of data $D_N$ and the computed result is output as data $D_K$ showin the acceleration of the diesel engine 2 at each instant.

Data $D_N$, $D_K$, $D_W$, $D_T$ and $D_A$ are input to the first control unit 10, in which the optimum fuel injection timing for the operating condition of the diesel engine 2 at each instant is computed on the basis of the input data, and a first control signal $CS_1$ is produced for driving the solenoid valve 8 in such a way that the actual fuel injection timing shown by data $D_T$ is made coindicent with the computed optimum fuel injection timing.

Figure 2:
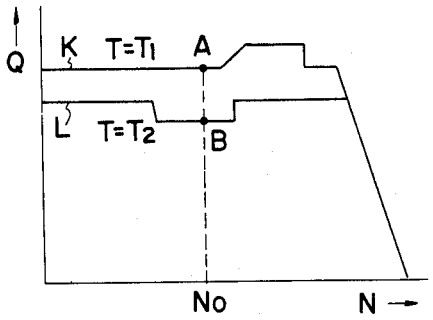
FIGS. 2 and 3 are graphs showing characteristic curves used for explanation of the operation of the apparatus shown in FIG. 1.

On the other hand, data $D_A$, $D_T$ and $D_N$ are applied to the second control unit 11, in which a computation for positioning the control rack 6 is carried out in order to control the rotational speed of the diesel engine 2 in accordance with a predetermined governor characteristic curve as shown in FIG. 2, and a second control signal $CS_2$ for driving the actuator 7 is produced in accordance with the result of the computation. In the second control unit 11, the partial load is computed as a function of the rotational speed of the diesel engine 2 and the amount of operation of the accelerator pedal 13, while the maximum fuel injection is computed as a function of the rotational speed of the diesel engine 2 and the fuel injection timing at each instant.

In this embodiment, as will be understood from the above description, the fuel injection timing is controlled by a closed-loop control system in which the difference between a target injection timing computed as the optimum timing and the actual timing is fed back. In the second control unit 11, the maximum fuel injection is corrected in accordance with the date $D_T$ showing the actual fuel injection timing in such a way that the engine torque determined in accordance with the maximum fuel injection does not vary even when the fuel injection timing is controlled by the timer 4.

Figure 3:
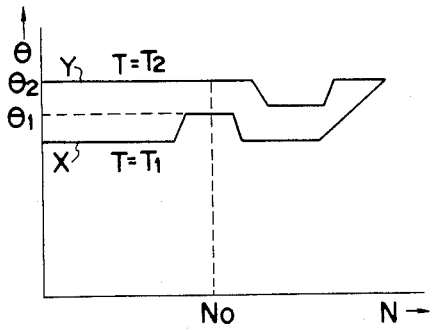

FIG. 3 shows a characteristic curve of the relationship between the timing $\theta$ of fuel injection and the speed N of the diesel engine 2. In FIG. 3, $\theta$ indicates the injection advance angle, the curve X indicates the fuel injection timing characteristic when the coolant temperature T is $T_1$ and the curve Y indicates the same characteristic when the coolant temperature T is $T_2$. It will be understood from FIG. 3 that the timing $\theta$ varies even if the engine speed N does not change when some other separating condition of the diesel engine 2 changes. For example, when the coolant temperature T changes from $T_1$ to $T_2$ with the engine speed N kept at $N_0$, as shown in FIG. 3, the timing $\theta$ is changed from $\theta_1$ to $\theta_2$. The change in the timing $\theta$ has an effect on the engine torque.

In order to prevent the engine torque corresponding to the maximum fuel injection from being changed because of the change in the fuel injection timing at each engine speed N, in the second control unit 11, the maximum fuel injection is controlled in response to data $D_T$, for example, such that, for example, the characteristic curve K of maximum fuel injection at $T=T_1$ is changed to the characteristic curve L when the coolant temperature T changes from $T_1$ to $T_2$.

As described above, in this control system, the maximum fuel injection is determined so as to cancel the change in the engine torque that would otherwise occur due to the change in the timing $\theta$. As a result, for example, in FIG. 2 showing the relationship between the amount Q of fuel injected and engine speed N, the engine torque for maximum fuel injection at $N=N_0$ and $T=T_1$ (i.e., at the operating point A) is equal to the engine torque for maximum fuel injection at $N=N_0$ and $T=T_1$ (i.e., at the operating point B).

With this structure, the diesel engine 2 can be operated with the optimum fuel injection timing while preventing variation in the engine torque at maximum fuel injection, regardless of any adjustment of the fuel injection timing. Consequently, the feel of engine operation control is good.

Figure 4:
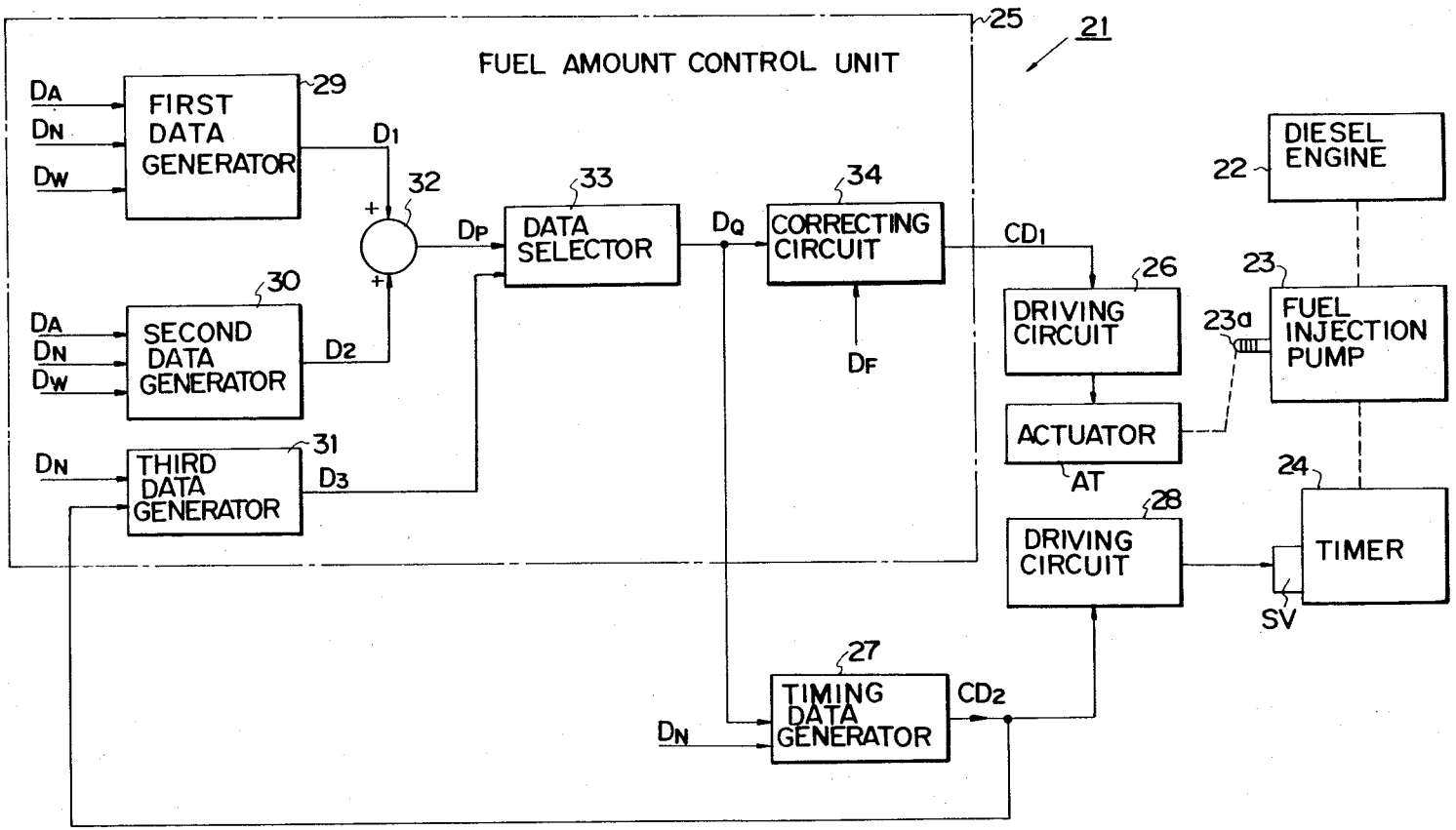
FIG. 4 is a block diagram of another embodiment of a fuel injection apparatus of the present invention.

FIG. 4 shows another embodiment of the present invention, in which the structure is more concretely illustrated. A fuel injection apparatus 21 has a fuel injection pump 23 for supplying fuel to a diesel engine 22, and a timer 24 for adjusting the timing of fuel injection by the fuel injection pump 23. A control rack $23_a$ of the fuel injection pump 23 is connected with an actuator AT controlled by a driving circuit 26 which is operated in response to control data $CD_1$ from a fuel amount control unit 25. The timer 24 has a solenoid valve SV for actuating an advance angle adjusting member (not shown) in the timer 24 and the solenoid valve SV is controlled by a driving circuit 28 which is operated in response to control data $CD_2$ produced by a timing data generator 27.

The fuel amount control unit 25 corresponds to the second control unit 11 in FIG. 1 and comprises a first data generator 29 for generating idle data $D_1$ concerning the idling characteristic portion of a predetermined governor characteristic curve, a second data generator 30 for generating partial load data $D_2$ concerning the partial load characteristic and a third data generator 31 for generating full Q data $D_3$ concerning the maximum fuel injection. Data $D_A$, $D_N$ and $D_W$ which are of the same nature as those described with respect to FIG. 1, are applied from a sensor unit (not shown) to the first and second data generators 29 and 30, and the idle data $D_1$ and partial load data $D_2$ are generated from the first and second data generators 29 and 30, respectively. Idle data $D_1$ and partial data $D_2$ are added together with by an adder 32 and the resulting data $D_P$ is applied to a data selector 33.

Data $D_N$ showing the rotational speed of the diesel engine 22 and the control data $CD_2$ generated from the timing data generator 27 are input to the third data generator 31. In the embodiment shown in FIG. 4, the fuel injecting timing is controlled in the open-loop control mode by the use of the control data $CD_2$, with the control data $CD_2$ being used as target data indicative of the optimum fuel injection timing corresponding to the operating condition of the diesel engine 22 at each instant.

The full Q data $D_3$ determining the maximum fuel injection is computed in the third data generator 31 on the basis of data $D_N$ and $CD_2$. The computation of the full Q data $D_3$ in the third data generator 31 is performed in such a way that the engine torque characteristic corresponding to the maximum fuel injection characteristic determined by the full Q data $D_3$ does not vary even if the fuel injection timing is adjusted by the timer 4.

Such a computation of the full Q data $D_3$ can easily be realized by a so-called map calculation using a ROM in which a number of data are stored in advance at respective addresses, and the required data is read out by applying thereto the data $D_N$ and $CD_2$ as address data. The map or table stored in the ROM can be determined experimentally.

The full Q data $D_3$ is also applied to the data selector 33 which selects the smaller of the two input data and outputs the selected data as fuel amount data $D_Q$. As a result, when data $D_P$ is larger than data $D_3$, the data $D_P$ is not derived from the data selector 33 as the fuel amount data $D_Q$, so that the maximum amount of fuel injected never exceeds the amount determined by data $D_3$. The fuel amount data $D_Q$ is input to a correcting circuit 34 in which it is corrected in accordance with data $D_F$ showing the fuel temperature, and the fuel amount data $D_Q$ corrected by the correcting circuit 34 is output as the control data $CD_1$.

The fuel amount data $D_Q$ and data $D_N$ are input to the timing data generator 27 which is also constituted by the use of ROM so as to carry out a map calculation similar to the third data generator 31 and to compute control data $CD_2$ showing a target fuel injection timing.

In the fuel injection apparatus shown in FIG. 4, since the fuel injection timing is controlled in a open-loop control mode by the use of the data $CD_2$, the same engine torque at maximum fuel injection can alway be obtained if the engine speed is the same in the same way as with the apparatus shown in FIG. 1.

In these embodiment, only the maximum fuel injection is controlled in accordance with the fuel injection timing so as to eliminate any change in the engine torque. However, similar control can, of course, be applied to the region of partial load of the governor characteristic.

We claim:

1. A fuel injection apparatus for an internal combustion engine in which the fuel injection timing and the amount of fuel injection are controlled in response to at least one condition signal indicating the operating condition of the engine, comprising:

a first control means for controlling the fuel injection timing by timing data provided in response to said condition signal; and a second control means for controlling the amount of fuel injection in response to said condition signal and timing data concerning the fuel injection timing set by said first control means, said second control means being provided with a first means for producing first fuel injection data for setting the maximum fuel injection amount at each instant and ajusting said timing data in such a way that the engine torque corresponding to the maximum fuel injection does not substantially change even when the fuel injection timing is adjusted by said first control means.

2. A fuel injection apparatus for an internal combustion engine as claimed in claim 1 wherein the fuel injection timing is controlled in the closed-loop control mode in said first control means.

3. A fuel injection apparatus for an internal combustion engine as claimed in claim 2 wherein said first control means operates in response to an actual timing signal indicative of the actual fuel injection timing.

4. A fuel injection apparatus for an internal combustion engine as claimed in claims 1 wherein said first means produces first fuel injection data corresponding to the maximum fuel injection in response to timing data and speed data indicative of the speed of the engine.

5. A full injection apparatus for an internal combustion engine as claimed in claim 1 wherein the fuel injection timing is controlled in the open-loop control mode in said first control means.

6. A fuel injection apparatus for an internal combustion engine as claimed in claim 5 wherein said first control means has a timing data generator which produces data for controlling the fuel injection timing in response to data from said second control means concerning the set amount of fuel injection.

7. A fuel injection apparatus for an internal combustion engine as claimed in claim 5 wherein said second control means has a second means for producing second fuel injection data indicating the amount of fuel injection required for the operating condition of the engine at each instant, and means for selecting the smaller of the first fuel injection data and the second fuel injection data, whereby the amount of fuel injection is never more than the amount determined by the first fuel injection data.

8. A fuel injection apparatus for and internal combustion engine as claimed in claim 2 wherein said first means produces first fuel injection data corresponding to the maximum fuel injection in response to timing data and speed data indicative of the speed of the engine.

9. A fuel injection apparatus for an internal combustion engine as claimed in claim 3 wherein said first means produces first fuel injection data corresponding to the maximum fuel injection in response to timing data and speed data indicative of the speed of the engine.

* * * * *